US008490675B2

(12) United States Patent
Tsuzuki et al.

(10) Patent No.: US 8,490,675 B2
(45) **Date of Patent: *Jul. 23, 2013**

(54) MACHINE AND A METHOD FOR SUCTIONING AND EXHAUSTING AIR FROM A STORAGE TANK FOR SAND IN A MOLDING MACHINE

(75) Inventors: Shuichi Tsuzuki, Toyokawa (JP); Yutaka Hadano, Toyokawa (JP); Takayuki Komiyama, Toyokawa (JP); Shuji Takasu, Toyokawa (JP); Takuya Nitta, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/521,861

(22) PCT Filed: Mar. 25, 2010

(86) PCT No.: PCT/JP2010/055184

§ 371 (c)(1),
(2), (4) Date: Sep. 11, 2012

(87) PCT Pub. No.: WO2011/086711

PCT Pub. Date: Jul. 21, 2011

(65) Prior Publication Data

US 2012/0325422 A1 Dec. 27, 2012

(30) Foreign Application Priority Data

Jan. 13, 2010 (JP) ..... 2010-005048

(51) Int. Cl.
*B22C 15/24* (2006.01)

(52) U.S. Cl.
USPC ..... 164/200; 164/202; 164/19; 164/20

(58) Field of Classification Search
USPC ..... 164/19–22, 200–202
See application file for complete search history.

(56) References Cited

U.S. PATENT DOCUMENTS 6,752,196 B2 * 6/2004 Kaneto et al. ..... 164/20
2008/0169083 A1 7/2008 Harada et al.

FOREIGN PATENT DOCUMENTS

JP 51-79510 6/1976
JP 52-26316 2/1977

(Continued)

OTHER PUBLICATIONS

International Search Report issued by the Japanese Patent Office in International Application No. PCT/JP2010/055184, mailed May 25, 2010 (2 pages).

*Primary Examiner* — Kevin P Kerns
*Assistant Examiner* — Kevin E Yoon
(74) *Attorney, Agent, or Firm* — Finnegan, Henderson, Farabow, Garrett & Dunner, L.L.P.

(57) ABSTRACT

The present invention is to provide a machine and a method for suctioning and exhausting air from a storage tank for sand in a molding machine that has less on-off valves and prevents sand from adhering to the interior of the valve for exhausting air while the air is being exhausted. The machine for suctioning and exhausting air from the storage tank for the sand in the molding machine comprises a storage tank for sand in the molding machine, a porous body that is provided in the storage tank for sand and that is distant from an inner face of the storage tank for sand, an empty chamber that is formed by an outer face of the porous body and the inner face of the storage tank for sand, a seal that is placed at a rim of a tip of a nozzle of the storage tank for filling sand and that expands when compressed air is supplied inside the seal, a pilot-operated valve for both suctioning and exhausting air that is fluidly connected to the empty chamber, and an on-off valve that is fluidly connected to the pilot-operated valve for both suctioning and exhausting air and connected to an inside of the seal.

3 Claims, 1 Drawing Sheet

FOREIGN PATENT DOCUMENTS

| | | | |
|---|---|---|---|
| JP | 59024552 A | * | 2/1984 |
| JP | 63-303651 | | 12/1988 |
| JP | 2002-210541 | | 7/2002 |
| WO | WO 2008/087772 A1 | | 7/2008 |

* cited by examiner

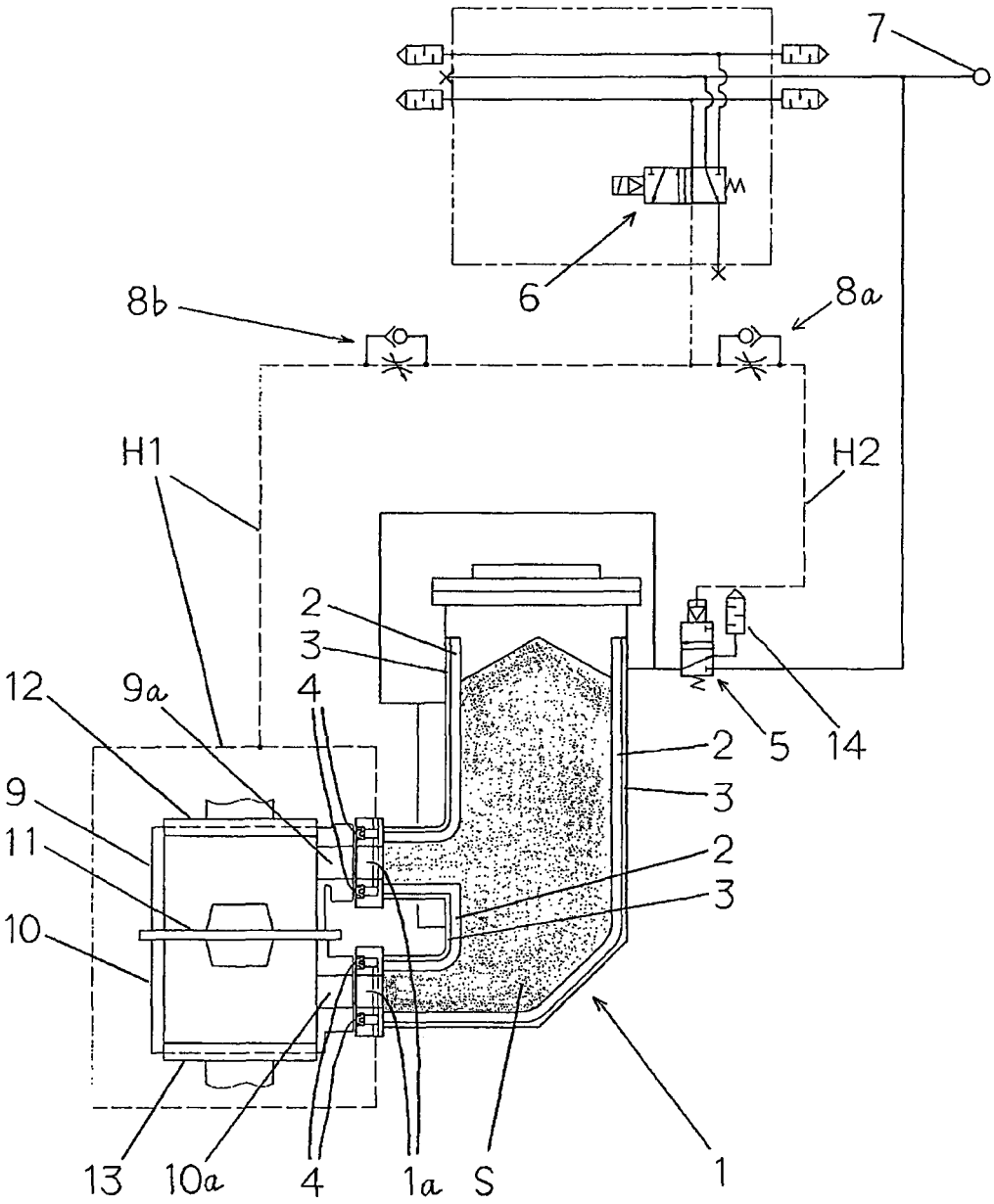
7
6
8b
8a
H1
H2
2
3
4
12
9a
9
11
10
5
14
2
3
2
3
13
10a
4
1a
S
1

MACHINE AND A METHOD FOR SUCTIONING AND EXHAUSTING AIR FROM A STORAGE TANK FOR SAND IN A MOLDING MACHINE

TECHNICAL FIELD

The present invention relates to a machine and a method for suctioning and exhausting air from a storage tank for sand in a molding machine.

BACKGROUND ART

Conventionally, a machine for suctioning and exhausting air from a storage tank for sand in a molding machine comprises both a valve for suctioning air and a valve for exhausting air from a storage tank for sand (see, for example, Japanese Patent Laid-open Publication No. 2002-210541). Further, as the invention disclosed in Japanese Patent Laid-open Publication No. S52-26316, a seal (the seal 7 in that publication) that expands when compressed air is supplied is provided at the rim of the tip of a nozzle for filling the sand of the storage tank so as to tightly attach the nozzle to a flask.

DISCLOSURE OF INVENTION

However, if both the valve for suctioning air and the valve for exhausting air are provided like the invention of Japanese Patent Laid-open Publication No. 2002-210541, there is a problem of the increased cost of the machine because of the two on-off valves. Even though the two valves are provided, sand can easily adhere to the interior of the valve for exhausting air while the air is being exhausted. This may deteriorate the functions of that valve. If a seal that expands when compressed air is supplied is provided at the rim of the tip of a nozzle for filling the sand of the storage tank like the invention disclosed in Japanese Patent Laid-open Publication No. S52-26316, an on-off valve for introducing the compressed air is needed. That valve is normally in addition to the valves for suctioning and exhausting air. Thus one more on-off valve is needed in addition to the valves for suctioning and exhausting air. Therefore, there is a problem in that the cost for the machine further increases.

The present invention was conceived to solve these problems. The object of it is to provide a machine and a method for suctioning and exhausting air from a storage tank for sand in a molding machine that has less on-off valves and prevents sand from adhering to the interior of the valve for exhausting air while the air is being exhausted.

To achieve the object, the machine for suctioning and exhausting air from a storage tank for sand in the molding machine of the present invention comprises a storage tank for the sand in the molding machine, a porous body that is located inside the storage tank for the sand and is distant from the inner face of the storage tank, an empty chamber that is formed by the outer face of the porous body and the inner face of the storage tank for the sand, a seal that is placed at the rim of the tip of a nozzle for filling the sand of the storage tank and that expands when compressed air is supplied inside the seal, a pilot-operated valve for both suctioning and exhausting air that is fluidly connected to the empty chamber, and an on-off valve that is fluidly connected to the pilot-operated valve for both suctioning and exhausting air and connected to the inside of the seal.

The machine for suctioning and exhausting air from the storage tank for the sand in the molding machine of the present invention is characterized in that speed control valves are provided between the on-off valve and the pilot-operated valve for suctioning and exhausting air and between the on-off valve and the inside of the seal.

To achieve the object, the method for suctioning and exhausting air from a storage tank for sand in the molding machine of the present invention is a method that utilizes that machine for suctioning and exhausting air from the storage tank for the sand in the molding machine. The method comprises the step of filling a flask with molding sand that is stored in the storage tank in the molding machine. The on-off valve is opened so that the seal is expanded to be tightly attached to the rim of the tip of the port for introducing the sand into the flask. By opening the pilot-operated valve for suctioning and exhausting air, compressed air is supplied inside the storage tank for the sand via the empty chamber and the porous body. Thus the molding sand fills the flask. The method also comprises the step of causing the compressed air to be exhausted from the storage tank for the sand via the porous body and the empty chamber. The on-off valve is closed so that the seal is shrunk, so that it is detached from the rim of the tip of the port for introducing the sand into the flask, and so that the pilot-operated valve for suctioning and exhausting air is closed. By closing the pilot-operated valve for suctioning and exhausting air the compressed air is exhausted from the storage tank for the sand via the porous body and the empty chamber.

The method for suctioning and exhausting air from the storage tank for the sand in the molding machine of the present invention is characterized in that speed control valves are provided between the on-off valve and the pilot-operated valve for suctioning and exhausting air and between the on-off valve and the inside of the seal. By adjusting the speed control valves the seal is expanded to be tightly attached to the rim of the tip of the port for introducing the sand into the flask before the pilot-operated valve for suctioning and exhausting air is opened.

Since by the present invention the machine comprises a storage tank for the sand in a molding machine, a porous body that is located inside the storage tank for the sand and is distant from the inner face of the storage tank, an empty chamber that is formed by the outer face of the porous body and the inner face of the storage tank for the sand, a seal that is placed at the rim of the tip of a nozzle for filling the sand of the storage tank and that expands when compressed air is supplied inside the seal, a pilot-operated valve for both suctioning and exhausting air that is fluidly connected to the empty chamber, and an on-off valve that is fluidly connected to the pilot-operated valve for both suctioning and exhausting air and connected to the seal, it has various advantageous effects, such as reducing the number of on-off valves that are used in the machine and preventing the sand from adhering to the interior of the valve for exhausting air when the air is being exhausted.

The basic Japanese Patent Application, No. 2010-005048, filed Jan. 13, 2010, is hereby incorporated by reference in its entirety in the present application.

The present inventions will become more fully understood from the detailed description given below. However, the detailed description and the specific embodiment are illustrations of desired embodiments of the present inventions, and are described only for an explanation. Various changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present inventions in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the inventions, and so does not limit the scope of the inventions, unless otherwise claimed.

BRIEF DESCRIPTION OF DRAWINGS

FIG. 1 is a schematic structural drawing that illustrates an embodiment of the present invention.

BEST MODE FOR CARRYING OUT THE INVENTION

Below, an embodiment of the present invention is in detail described with reference to the drawing. FIG. 1 is a schematic structural drawing that illustrates an embodiment of the present invention. It mainly shows a storage tank for the sand in a molding machine. Thus elements of the molding machine other than the storage tank for the sand are omitted in that drawing.

In FIG. 1, within a storage tank 1 for sand in a molding machine a porous body 2 is provided so that it is distant from the inner face of the storage tank 1 for the sand. An empty chamber 3 is formed by the outer face of the porous body 2 and the inner face of the storage tank 1. At the upper end of the storage tank 1 a sliding gate (not shown) is provided. In the present embodiment the porous body 2 is manufactured by sintering ultrahigh molecular weight polyethylene.

A seal 4 that expands when compressed air is supplied inside it (the material of it is nitrile rubber in the present embodiment) is placed at the rim of the tip of the nozzle 1*a* of the storage tank 1 for filling the sand. A pilot-operated valve 5 for both suctioning and exhausting air is fluidly connected to the empty chamber 3.

The pilot-operated valve 5 for suctioning and exhausting air and the inside of the seal 4 are fluidly connected to an on-off valve 6 (an electromagnetic on-off valve in the present embodiment). The on-off valve 6 and the pilot-operated valve 5 for suctioning and exhausting air are fluidly connected to a source 7 for compressed air. Speed control valves (speed controllers) 8*a*, 8*b* are respectively provided between the on-off valve 6 and the pilot-operated valve 5 for suctioning and exhausting air and between the on-off valve 6 and the inside of the seal 4.

In the present embodiment the molding machine is a flaskless molding machine. FIG. 1 illustrates the status when the upper flask 9 and lower flask 10 clamp a matchplate 11 and when an upper squeezing member 12 and lower squeezing member 13 are respectively inserted into the upper and lower flasks 9, 10 so that molding cavities are formed in both the upper and lower flasks 9, 10, FIG. 1 shows that the ports 9*a*, 10*a* for introducing the sand of the upper and lower flasks 9, 10 face the nozzle of the storage tank 11*a* for filling the sand. Molding sand S that is stored in a space formed by the porous body 2 in the storage tank 1 is being filled into the upper and lower flasks 9, 10. The molding sand S that is used in the present invention may be, for example, green sand or ceramic artificial sand.

Now the operation by that structure is described. When the sliding gate (not shown) is closed and the molding sand S is stored in the storage tank 1 for the sand (as seen in FIG. 1), the on-off valve 6 is opened. By doing so, compressed air is introduced inside the seal 4 via a piping H1 so that the seal 4 is expanded so that it is tightly attached to the rim of the tip of the port 9*a*, 10*a* for introducing the sand of the upper and lower flasks 9, 10. Further, by opening the on-off valve 6, compressed air is introduced into the pilot-operated valve 5 for suctioning and exhausting air via a piping H2 so that the pilot-operated valve 5 is opened. Then compressed air is supplied inside the storage tank 1 for the sand via the empty chamber 3 and the porous body 2. Thus the molding sand S in the storage tank 1 is fluidized so as to be filled in the molding cavities in the upper and lower flasks 9, 10 via the nozzle 1*a* of the storage tank 1 for filling the sand and the ports 9*a*, 10*a* for introducing the sand of the upper and lower flasks 9, 10.

Next, the on-off valve 6 is closed. Then the seal 4 is shrunk so that it is detached from the rim of the tip of the port 9*a*, 10*a* for introducing the sand of the upper and lower flasks 9, 10. Further, by closing the on-off valve 6, the pilot-operated valve 5 for suctioning and exhausting air is closed. Then compressed air in the storage tank 1 is exhausted from the storage tank 1 via the porous body 2 and the empty chamber 3. The exhausted compressed air is discharged to the atmosphere from a silencer 14 that is placed at the pilot-operated valve 5 for suctioning and exhausting air.

In the present embodiment the speed control valves 8*a*, 8*b* are preliminarily adjusted. They are precisely adjusted so that the flow of compressed air through the speed control valve 8*b* that is located between the on-off valve 6 and the inside of the seal 4 is more than that through the speed control valve 8*a* that is located between the on-off valve 6 and the pilot-operated valve 5 for suctioning and exhausting air. By so adjusting the valves, before the pilot-operated valve 5 for suctioning and exhausting air is opened, the seal 4 is expanded so that it is attached to the rim of the tip of the ports 9*a*, 10*a* for introducing the sand of the upper and lower flasks 9, 10. Thus when the molding sand S is filled in the molding cavities in the upper and lower flasks 9, 10, it is reliably prevented from leaking through the gap between the tip of the nozzle 1*a* of the storage tank 1 for filling the sand and the tips of the ports 9*a*, 10*a* for introducing the sand of the upper and lower flasks 9, 10.

By the present invention the porous body 2 is provided so that it is distant from the inner face of the storage tank 1 for the sand in the tank 1. The empty chamber 3 is formed by the outer face of the porous body 2 and the inner face of the storage tank 1 for the sand. The pilot-operated valve 5 for suctioning and exhausting air is fluidly connected to the empty chamber 3. Thus when the compressed air is exhausted from the storage tank 1 for the sand, it passes through the porous body 2. The porous body 2 functions as a filter that prevents the molding sand S from passing through it. Only clean air that does not contain sand passes through the empty chamber 3 and the pilot-operated valve 5 for suctioning and exhausting air. Therefore sand is prevented from adhering to the interior of the pilot-operated valve 5 for suctioning and exhausting air. Since the exhausted compressed air is clean and contains no sand, there is no need to install both the valve for suctioning air and the valve for exhausting air that are conventionally needed. Since just one pilot-operated valve 5 for both suctioning air and exhausting air is used, the number of on-off valves that are used is reduced.

By the present invention both the pilot-operated valve 5 for suctioning and exhausting air and the inside of the seal 4 are fluidly connected to the on-off valve 6. To concretely describe the embodiment, the piping H1 and the piping H2 are merged so as to be connected to the on-off valve 6. Thus opening and closing the pilot-operated valve 5 and expanding and shrinking the seal 4 are carried out by only one on-off valve 6. Therefore, the number of on-off valves that are used is reduced.

In the present embodiment the speed control valves 8*a*, 8*b* are respectively provided between the on-off valve 6 and the pilot-operated valve 5 for suctioning and exhausting air and between the on-off valve 6 and the inside of the seal 4. However an embodiment is not limited to that structure. The speed control valves 8*a*, 8*b* may be omitted if the seal 4 is expanded so that it is tightly attached to the rim of the tip of the ports 9*a*, 10*a* for introducing the sand of the upper and lower flasks 9, 10 before the pilot-operated valve 5 is opened. However, it is preferable to definitely expand the seal 4 so that it is tightly attached to the rim of the tip of the ports 9*a*, 10*a* for introducing the sand of the upper and lower flasks 9, 10 before the pilot-operated valve 5 is opened by adjusting the speed control valves 8*a*, 8*b* that are provided between the on-off valve 6 and the pilot-operated valve 5 for suctioning and exhausting air and between the on-off valve 6 and the inside of the seal 4 as discussed above.

In the present embodiment only one pilot-operated valve 5 for suctioning and exhausting air is used. However, an embodiment is not limited to that structure. A plurality of the pilot-operated valves 5 for suctioning and exhausting air may be used depending on the size of the storage tank 1 for the sand. In this case by fluidly connecting all the plurality of the pilot-operated valves 5 to the on-off valve 6, the plurality of the pilot-operated valves 5 can be simultaneously operated by operating the one on-off valve 6.

The invention claimed is:

1. A machine for suctioning and exhausting air from a storage tank for sand in a molding machine comprising:

a storage tank for sand in the molding machine;

a porous body that is provided in the storage tank for sand and that is distant from an inner face of the storage tank for sand;

an empty chamber that is formed by an outer face of the porous body and the inner face of the storage tank for sand;

a seal that is placed at a rim of a tip of a nozzle for filling sand of the storage tank for sand and that expands when compressed air is supplied inside the seal;

a pilot-operated valve for both suctioning and exhausting air that is fluidly connected to the empty chamber; and an on-off valve that is fluidly connected to the pilot-operated valve for both suctioning and exhausting air and connected to an inside of the seal wherein speed control valves are provided between the on-off valve and the pilot-operated valve for both suctioning and exhausting air and between the on-off valve and the inside of the seal.

2. A method for suctioning and exhausting air from a storage tank for sand in a molding machine utilizing the machine for suctioning and exhausting air from the storage tank for sand in the molding machine of claim 1, the method comprising the steps of:

filling a flask with molding sand that is stored in the storage tank for sand by opening the on-off valve while the molding sand is stored in the storage tank for sand so that, while the seal is expanded to be tightly attached to the rim of the tip of the port for introducing the sand into the flask, the pilot-operated valve for suctioning and exhausting air is opened so as to supply compressed air inside the storage tank for the sand via the empty chamber and the porous body; and causing the compressed air to be exhausted from the storage tank for sand via the porous body and the empty chamber by closing the on-off valve so that the seal is shrunk so that it is detached from the rim of the tip of the port for introducing the sand into the flask and so that the pilot-operated valve for suctioning and exhausting air is closed.

3. The method for suctioning and exhausting air from a storage tank for sand in a molding machine of claim 2, wherein the speed control valves are adjusted so that the seal is expanded so that it is tightly attached to the rim of the tip of the port for introducing the sand into the flask before the pilot-operated valve for suctioning and exhausting air is opened.

* * * * *